US008453351B1

(12) United States Patent
Hale

(10) Patent No.: US 8,453,351 B1
(45) Date of Patent: Jun. 4, 2013

(54) SHOE WITH A HEIGHT-ADJUSTABLE HEEL

(76) Inventor: Allisa J. Hale, Lansing, IL (US)

( * ) Notice: Subject to any disclaimer, the term of this patent is extended or adjusted under 35 U.S.C. 154(b) by 186 days.

(21) Appl. No.: 13/108,715

(22) Filed: May 16, 2011

(51) Int. Cl.
*A43B 21/00* (2006.01)

(52) U.S. Cl.
USPC ..... 36/105; 36/100; 36/29

(58) Field of Classification Search
USPC ..... 36/36 R, 36 A, 36 B, 36 C, 41, 24, 36/155, 29, 35 B, 35 A, 39, 100; 297/344.19
See application file for complete search history.

(56) References Cited

U.S. PATENT DOCUMENTS

| | | | | |
|---|---|---|---|---|
| 2,707,341 | A | 5/1955 | Romano | |
| 2,934,840 | A * | 5/1960 | Mistarz | 36/34 R |
| 3,805,418 | A * | 4/1974 | Matuka et al. | 36/34 A |
| 4,416,072 | A | 11/1983 | Sarkissian | |
| 4,739,563 | A * | 4/1988 | Guggenberger et al. | 36/117.4 |
| 6,021,586 | A | 2/2000 | Bucalo et al. | |
| 7,140,125 | B2 * | 11/2006 | Singleton et al. | 36/38 |
| 2008/0128670 | A1 * | 6/2008 | Bogert | 254/93 H |
| 2008/0134542 | A1 * | 6/2008 | Shih | 36/42 |
| 2010/0199518 | A1 * | 8/2010 | Buttigieg | 36/29 |
| 2011/0067264 | A1 * | 3/2011 | Doyle | 36/29 |
| 2012/0000092 | A1 * | 1/2012 | Ingvarsson et al. | 36/88 |
| 2012/0073161 | A1 * | 3/2012 | Doyle | 36/29 |

* cited by examiner

*Primary Examiner* — Alissa Tompkins
*Assistant Examiner* — Cameron Carter

(57) ABSTRACT

A shoe with a height-adjustable heel including a heel having a first heel member fixedly attached to the sole and a second heel member telescopically disposed within the first heel member which is operated by a hydraulic pump disposed in the first heel member and a pump lever, pivotally disposed on a rear wall of the first heel member, by which the hydraulic pump is activated to extend and retract the second heel member to respectively lengthen and shorten the heel and which also includes a twist-lock valve mechanism in a heel tip that controls the passage of air into the hydraulic pump.

3 Claims, 3 Drawing Sheets

SHOE WITH A HEIGHT-ADJUSTABLE HEEL

BACKGROUND OF THE INVENTION

Various types of shoes having telescopic heels are known in the prior art. However, what is needed is a shoe with a height-adjustable heel including a heel having a first heel member fixedly attached to the sole and a second heel member telescopically disposed within the first heel member which is operated by a hydraulic pump disposed in the first heel member and a pump lever, pivotally disposed on a rear wall of the first heel member, by which the hydraulic pump is activated to extend and retract the second heel member to respectively lengthen and shorten the heel and which also includes a twist-lock valve mechanism in a heel tip that controls the passage of air into the hydraulic pump.

FIELD OF THE INVENTION

The present invention relates to shoes, and more particularly, to a shoe with a height-adjustable heel which includes a hydraulic pump disposed with in the heel.

SUMMARY OF THE INVENTION

The general purpose of the present shoe with a height-adjustable heel, described subsequently in greater detail, is to provide a shoe with a height-adjustable heel which has many novel features that result in a shoe with a height-adjustable heel which is not anticipated, rendered obvious, suggested, or even implied by prior art, either alone or in combination thereof.

To accomplish this, the present shoe with a height-adjustable heel includes an upper, a sole, and a heel configured in a position below the sole. The heel includes a first heel member fixedly attached to the sole rear end, an internal cavity vertically disposed therein, and a hydraulic pump vertically disposed within the internal cavity. A pump lever, which is in operation communication with the hydraulic pump, is pivotally disposed on the first heel member rear wall. The pump lever has an extended position in which the pump lever is substantially perpendicular to the first heel member and an alternate retracted position in which the pump lever concealed within a notch on a rear wall of the first heel member notch. An elongated cylindrical second heel member, which has a heel tip disposed on a distal end thereof, is telescopically disposed within the first heel member internal cavity. A twist-lock valve mechanism, disposed within the heel tip, has an open position and a closed position to permit and prevent the passage of an amount of air through into the hydraulic pump, respectively. The activation of the pump lever in an extended position with the twist-lock valve in an open position activates the hydraulic pump which, in turn, selectively extends the second heel member into a partially raised position and an alternate raised position. The deactivation of the pump lever in a retracted position deactivates the hydraulic pump which, in turn, retracts the second heel member into a lowered position.

The first heel member has a length in a range of approximately 1 inch to approximately 3 inches and the second heel member has a respective length in a range of slightly less than 1 inch to slightly less than 3 inches. The heel, thus, has a combined length of the first heel member and the second heel member in a range of approximately 2 inches to approximately 6 inches upon the selective retraction of the second heel member into the lowered position and alternately the extension of the second heel member into the partially raised position and the alternate raised position. The upper and the first heel member are configured as in a woman's high heel shoe.

Thus has been broadly outlined the more important features of the present shoe with a height-adjustable heel so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
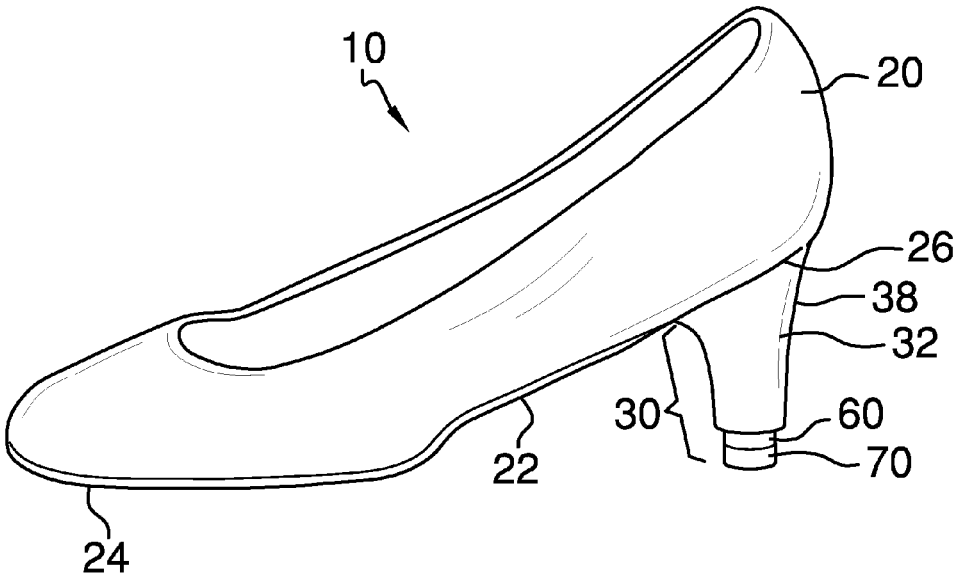
FIG. 1 is an isometric view illustrating a partially extended heel.
Figure 2:
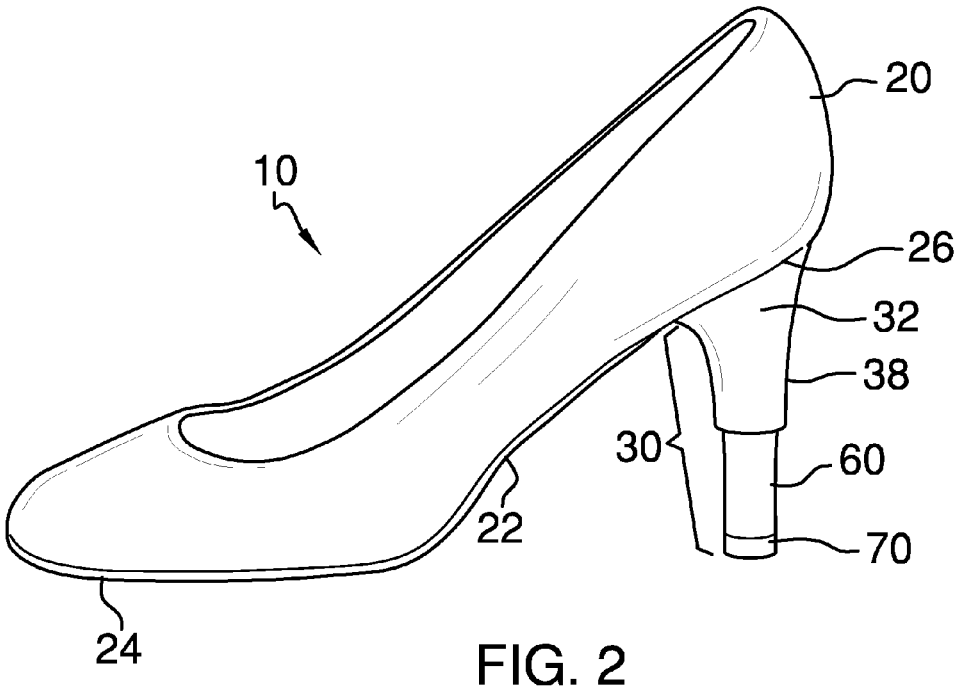
FIG. 2 is an isometric view illustrating a fully extended heel.
Figure 3:
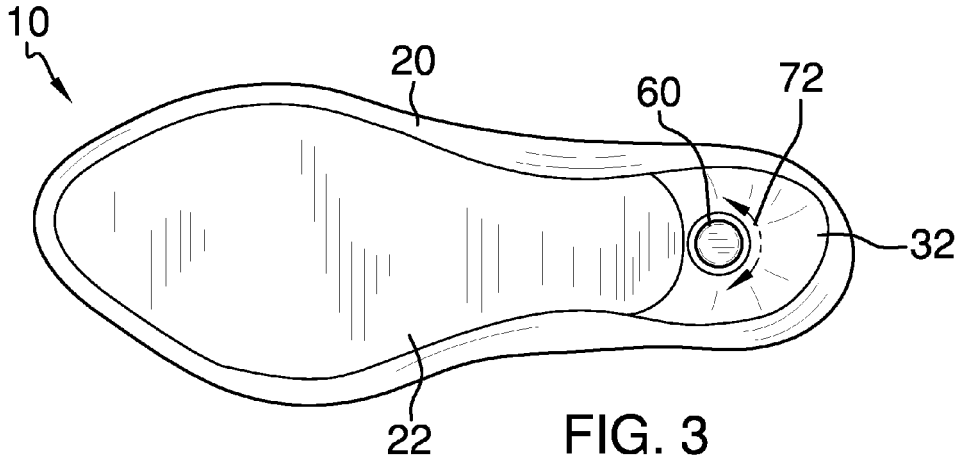
FIG. 3 is a bottom plan view.
Figure 4:
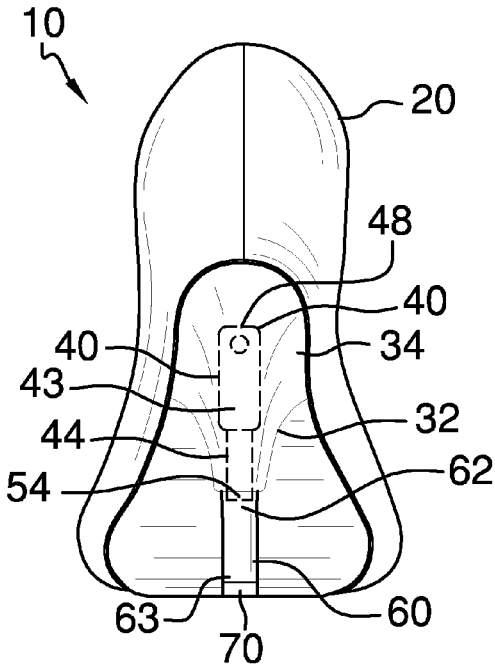
FIG. 4 is a rear elevation view.
Figure 5:
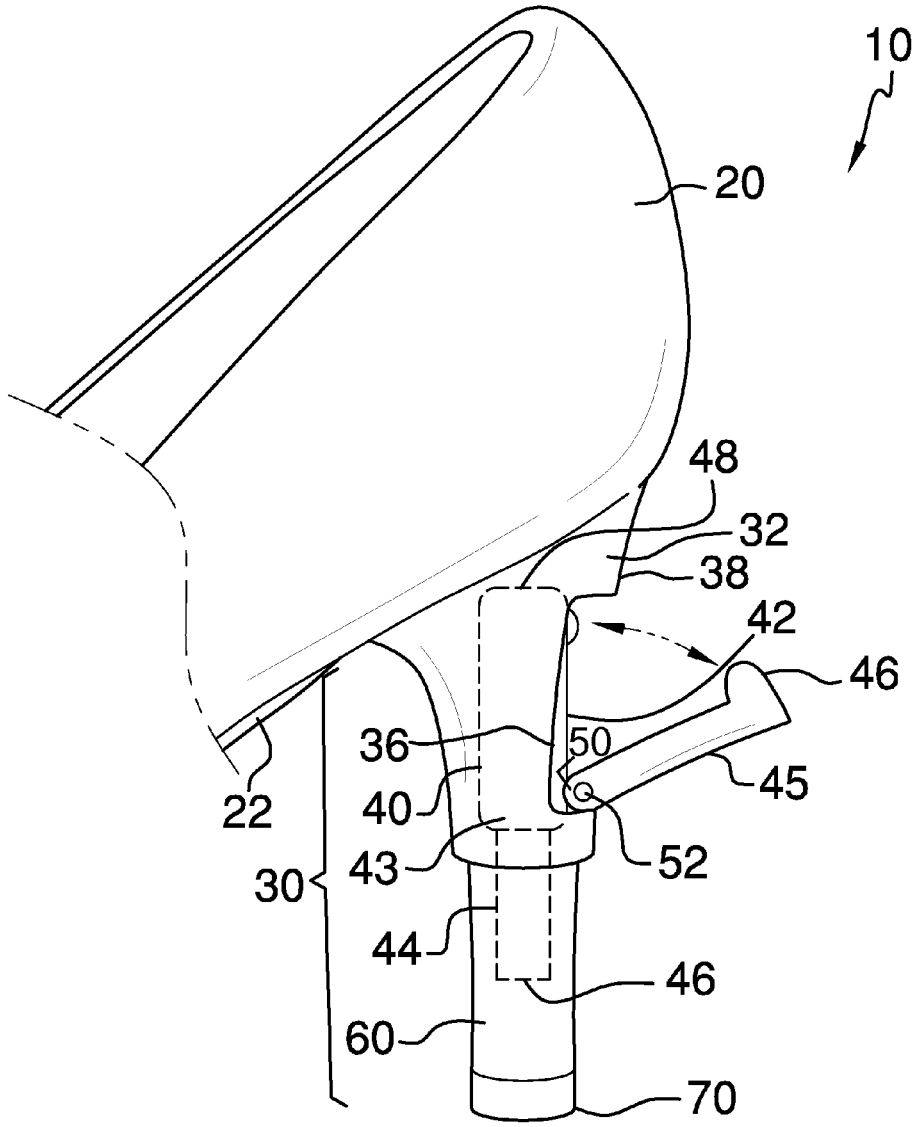
FIG. 5 is an enlarged isometric view detailing a pump disposed within the heel.

With reference now to the drawings, and in particular FIGS. 1 through 5 thereof, example of the instant shoe with a height-adjustable heel employing the principles and concepts of the present shoe with a height-adjustable heel and generally designated by the reference number 10 will be described.

Referring to FIGS. 1 through 5 a preferred embodiment of the present shoe with a height-adjustable heel 10 is illustrated. The instant shoe 10 includes an upper 20 and a sole 22 attached to the upper 20. The sole 22 has a front end 24 and a rear end 26. A heel 30 is configured in a position below the sole 22.

The heel 30 includes a first heel member 32 fixedly attached to the sole 22 rear end 26. An internal cavity 34 is vertically disposed within the first heel member 32. A hydraulic pump 40 is vertically disposed within the internal cavity 34. An elongated notch 36 is disposed on a rear wall 38 of the first heel member 32 proximal to a first side 42 of the hydraulic pump. The hydraulic pump 40 has an upper portion 43 and a lower portion 44. A pump lever 45 is pivotally disposed on the first heel member 32 rear wall 38. The pump lever 45 has an upper end 46 releasably disposed proximal to a top end 48 of the hydraulic pump 40 upper portion 43 and also a lower end 50. A pivot point 52 is disposed on the pump lever 45 lower end 50 and attaches the pump lever 45 to the first heel member 32. The pivot point 52 is disposed proximal to a bottom end 54 of the hydraulic pump 40 lower portion 42. The pump lever 45 has an extended position in which the pump lever 45 is substantially perpendicular to the first heel member 32 and an alternate retracted position in which the pump lever 45 is disposed within the first heel member 32 notch 36 for concealment within the rear wall 38 of the first heel member 32 when not in use. The pump lever 45 is in operational communication with the hydraulic pump 40.

An elongated cylindrical second heel member 60 is telescopically disposed within the first heel member 32 internal cavity 34. The second heel member 60 has a proximal end 62 and a distal end 63. The second heel member 60 has a diameter slightly smaller than a diameter of first heel member 32. The second heel member 60 is disposed within the first heel member 32 internal cavity 34 to permit the operational communication of second heel member with the hydraulic pump 40 while also concealing the portion of the second heel member 70 that is not extended within the first heel member 32.

The hydraulic pump 40 lower portion 44 is centrally slidingly disposed within the second heel member 60.

A heel tip 70 is attached to the second heel member 60 distal end 63. A twist-lock valve mechanism 72 is disposed within the heel tip 70. The twist-lock valve mechanism 72 has an open position and an alternate closed position. In the open position, the twist-lock valve mechanism 72 permits the passage of an amount of air through into the hydraulic pump 40. In the alternate closed position, the twist-lock valve mechanism 72 prevents the passage of air into the hydraulic pump 40. The disposal of the twist-lock valve mechanism 72 within the heel tip 70 also conceals the twist-lock valve mechanism 72 to prevent injury which may otherwise be caused if the mechanism were externally disposed on the shoe 10 or heel 30, while also promoting a visually pleasing heel 30.

The activation of the pump lever 45 in an extended position with the twist-lock valve 72 in an open position activates the hydraulic pump 50. The activation of the hydraulic pump 40 selectively extends the second heel member 60 into a partially raised position and an alternate raised position. The deactivation of the pump lever 45 in a retracted position deactivates the hydraulic pump 40. The deactivation of the hydraulic pump 40 selectively retracts the second heel member 60 into a lowered position.

The first heel member 32 has a length in a range of approximately 1 inch to approximately 3 inches and the second heel member 60 has a respective length in a range of slightly less than 1 inch to slightly less than 3 inches. The heel 30 has a combined length of the first heel member 32 and the second heel member 60 in a range of approximately 2 inches to approximately 6 inches upon the selective retraction of the second heel member 60 into the lowered position and alternately the extension of the second heel member 60 into the partially raised position and the alternate raised position. The upper 20 and the first heel member 32 are configured as in a woman's high heel shoe.

What is claimed is:

1. A shoe with a height-adjustable heel comprising:

an upper;

a sole attached to the upper, the sole having a front end and a rear end;

a heel configured in a position below the sole, the heel comprising:

a first heel member fixedly attached to the sole rear end;

an internal cavity vertically disposed within the first heel member;

a hydraulic pump vertically disposed within the internal cavity, the hydraulic pump having an upper portion and a lower portion;

a pump lever pivotally disposed on a rear wall of the first heel member, the pump lever having an upper end releasably disposed proximal to a top end of the hydraulic pump upper portion and a lower end; and a pivot point disposed on the pump lever lower end, the pivot point disposed proximal to a bottom end of the hydraulic pump lower portion;

wherein the pump lever has an extended position and an alternate retracted position;

wherein the pump lever is in operational communication with the hydraulic pump;

an elongated cylindrical second heel member telescopically disposed within the first heel member internal cavity, the second heel member having a proximal end and a distal end;

wherein the hydraulic pump lower portion is centrally slidingly disposed within the second heel member;

a heel tip attached to the second heel member distal end; and a twist-lock valve mechanism disposed within the heel tip;

wherein the twist-lock valve mechanism has an open position and an alternate closed position;

wherein, in the open position, the twist-lock valve mechanism permits the passage of an amount of air into the hydraulic pump;

wherein, in the closed position, the twist-lock valve mechanism prevents the passage of the air into the hydraulic pump;

wherein the activation of the pump lever in an extended position with the twist-lock valve mechanism in the open position activates the hydraulic pump;

wherein the activation of the hydraulic pump selectively extends the second heel member into a partially raised position and an alternate raised position, whereby the heel is lengthened;

wherein the deactivation of the pump lever in a retracted position deactivates the hydraulic pump; and wherein the deactivation of the hydraulic pump selectively retracts the second heel member into a lowered position, whereby the heel is shortened.

2. The shoe of claim 1 wherein the first heel member has a length in a range of approximately 1 inch to approximately 3 inches and the second heel member has a respective length in a range of slightly less than 1 inch to slightly less than 3 inches;

wherein the heel has a combined length of the first heel member and the second heel member in a range of approximately 2 inches to approximately 6 inches upon the selective retraction of the second heel member into the lowered position and alternately the extension of the second heel member into the partially raised position and the alternate raised position.

3. The shoe of claim 2 wherein the upper and the first heel member are configured as in a woman's high heel shoe.

* * * * *